United States Patent [19]

Nelson

[11] 4,334,855

[45] Jun. 15, 1982

[54] FURNACE CONTROL USING INDUCED DRAFT BLOWER AND EXHAUST GAS DIFFERENTIAL PRESSURE SENSING

[75] Inventor: Lorne W. Nelson, Bloomington, Minn.

[73] Assignee: Honeywell Inc., Minneapolis, Minn.

[21] Appl. No.: 170,358

[22] Filed: Jul. 21, 1980

[51] Int. Cl.[3] ..... F23J 3/00; F23J 1/08

[52] U.S. Cl. ..... 431/20; 431/12; 126/116 A; 236/15 BD; 236/15 C

[58] Field of Search ..... 431/12, 20, 19, 75, 431/90, 84; 126/110 R, 116 A; 110/147, 162; 236/1 H, 11, 15 BD, 15 C, 45

[56] References Cited

U.S. PATENT DOCUMENTS

| | | | |
|---|---|---|---|
| 1,707,281 | 10/1925 | Sauvage . | |
| 1,743,731 | 2/1925 | Scott . | |
| 1,773,585 | 2/1928 | Klockau . | |
| 1,830,273 | 11/1930 | Hill . | |
| 2,011,754 | 8/1935 | Cornelius . | |
| 2,070,536 | 2/1937 | Hoffman . | |
| 2,123,163 | 7/1938 | Birkenbeuel . | |
| 2,218,930 | 3/1940 | Cunningham . | |
| 2,296,410 | 2/1940 | Wetzsteon . | |
| 2,410,384 | 2/1945 | Lindsay . | |
| 2,671,503 | 12/1951 | Logan et al. . | |
| 3,280,774 | 2/1965 | English . | |
| 3,294,146 | 4/1965 | Voorheis . | |
| 3,403,962 | 2/1967 | Suffron et al. . | |
| 3,587,490 | 6/1971 | Martin . | |
| 3,768,956 | 10/1973 | Mueller et al. | 236/45 X |
| 3,869,243 | 3/1975 | Creuz . | |
| 4,017,027 | 4/1977 | Smith . | |
| 4,108,369 | 8/1978 | Prikkel . | |
| 4,251,025 | 2/1981 | Bonne et al. | 431/12 X |

*Primary Examiner*—Samuel Scott
*Assistant Examiner*—Randall L. Green
*Attorney, Agent, or Firm*—Stuart R. Hemphill; Clyde C. Blinn

[57] ABSTRACT

A heating system of the type having a combustion chamber with a fuel burner, an inlet for combustion air and an exhaust stack is improved by adding a variable-speed induced draft blower, a flow-restricting stack orifice and a fuel valve sensitive to the exhaust gas flow rate through the stack orifice. The fuel valve turns on at a first predetermined exhaust gas flow rate and turns off at a second predetermined exhaust gas flow rate, which is lower than the first predetermined rate. The fuel valve also supplies fuel at a rate proportional to the exhaust gas flow rate. Sensing of the differential pressure across the stack orifice is used to determine the exhaust gas flow rate.

13 Claims, 7 Drawing Figures

FURNACE CONTROL USING INDUCED DRAFT BLOWER AND EXHAUST GAS DIFFERENTIAL PRESSURE SENSING

BACKGROUND OF THE INVENTION

1. Field of the Invention

This invention relates to combustion heating systems and control apparatus for such systems. More specifically, this invention relates to apparatus for constructing a furnace and its control system, to produce an induced draft furnace having increased efficiency.

2. Description of the Prior Art

Conventional gas-fired, natural draft furnace systems typically operate at a steady-state efficiency of about 75%. The seasonal average efficiency of such furnace systems is usually considerably lower, on the order of 60%. As the cost of gas and other fuels used for heating rises, and as such fuels grow scarcer, these levels of efficiency are considered less and less acceptable, and various ways of increasing furnace system efficiency are sought.

Several methods of increasing furnace efficiency are known in the prior art. For example, it is known that significant efficiency-reducing losses occur due to the escape of heat up the flue, vent, or exhaust stack during the portion of the furnace cycle when the burner is off. This heat is primarily heat taken from the burner heat exchanger following a burning cycle. One prior art solution to this form of heat loss is to provide dampers of various kinds which permit draft flow when required for the burning cycle, but serve to limit draft flow when the burner is not on. Examples of such dampers may be seen in the following U.S. Pat. Nos. 1,743,731; 1,773,585; 2,011,754; 2,218,930; 2,296,410; 4,017,027 and 4,108,369. As these patents show, a damper having the desired effect can be placed so as to limit exhaust draft flow out of the combustion chamber or input air flow into the combustion chamber.

A second form of efficiency-reducing loss in furnaces occurs due to inefficient burning as a result of improper air-fuel ratio. The prior art shows several methods for controlling fuel and/or air flow in order to maintain the air-fuel ratio as close as possible to the chemical ideal of stoichiometric burning, in which all fuel and oxygen would be completely combusted. Such prior art arrangements include U.S. Pat. No. 3,280,774, which shows an orifice plate of pre-selected cross-section and draft-limiting characteristics combined with a draft blower fan, and U.S. Pat. No. 2,296,410, which shows an apparatus for mechanically linking a modulating fuel regulator to a draft damper, to regulate the air supply in relation to the fuel supply.

A third form of efficiency-reducing loss in furnaces occurs due to the heat exchange process. Because it is impossible to transfer all the heat from the combustion chamber to the circulated air, water or other heat delivery medium, a certain amount of unabsorbed heat passes out of the heat exchanger and up the exhaust stack. One known way of reducing this type of loss is to derate the furnace, i.e., operate it at a lower firing rate. This permits a higher percentage of the heat produced by combustion to be absorbed in the heat exchanger. An example of a prior art patent disclosing a burner using derating is U.S. Pat. No. 3,869,243.

There are, however, certain disadvantages which may accompany a reduced firing rate. In particular, the following may arise: (1) slower response time in reaching the thermostatically selected room temperature; (2) possible inability to achieve the selected temperature; (3) increased condensation on the inside walls of the furnace chamber, or the interiors of tubing, valves, etc., associated with the furnace, leading to more rapid corrosion, rusting or other deterioration of such parts; and (4) mismatching of fuel and air ratios, often leading to high excess air conditions at firing rates below the design maximum.

SUMMARY OF THE INVENTION

The present invention involves an induced draft combustion apparatus and its associated control system, for producing an induced draft furnace having increased efficiency. With the present invention, a blower located in the exhaust stack or vent is used to induce the movement of air and combustion products into, through and out of the combustion chamber. A flow-restricting orifice means in the exhaust stack in proximity to the blower causes a region of higher pressure to exist upstream from the orifice with a region of lower pressure downstream from the orifice; thus, a pressure differential exists across the orifice. The exhaust gas pressure differential, which is representative of the exhaust gas volume flow rate, is sensed and is fed as a control signal back to a modulating gas valve which controls the outlet gas flow from the valve to be proportional to the magnitude of the exhaust gas pressure differential. By controlling blower speeds and exhaust gas volume flow capacities are related to a selected orifice size, various firing rates for the furnace can be selected, from the design maximum down to various derated levels.

With the present invention a significant improvement over the arrangements disclosed in the copending, commonly-assigned U.S. patent applications Ser. No. 57,051, filed July 12, 1979, now U.S. Pat. No. 4,251,025, for Furnace Control Using Induced Draft Blower and Exhaust Stack Flow Rate Sensing (listing as inventors Ulrich Bonne et al.) and Ser. No. 146,885, filed May 5, 1980 for Furnace Control Using Induced Draft Blower, Exhaust Gas Flow Rate Sensing and Density Compensation (listing as inventors Lorne W. Nelson et al.) is achieved, by use of a specially designed modulating gas valve which includes a differential pressure sensitive flapper valve to establish a minimum exhaust gas flow threshold for permitting fuel flow and to provide hysteresis for fuel shut off, as well as a differential pressure sensitive regulator section to drive a servo-regulator section to provide fuel flow at a pressure modulated in accordance with the sensed pressure differential.

Use of this valve in connection with a stack blower and stack orifice permits the furnace to operate at different firing rates and to maintain a relatively constant fuel-air ratio at the different firing rates. In addition, the differential pressure across the vent orifice is a positive means of indicating combustion air flow, because the pressure differential goes to zero with a blocked flue. Because the flapper valve delays fuel flow until a significant pressure differential is developed, the feedback tubing and related pressure sensing chambers are flushed at each furnace startup with air which does not contain combustion products. The present invention also enjoys other benefits of a system using a stack blower and flow-limiting stack orifice, namely reduced off-cycle heat loss, resistance to downdrafts and versatile exhaust gas discharge location. As an additional feature, the present invention contemplates conveying the differential pressure feedback signal in a multi-chambered conduit with exterior and interior passages, which design provides a fail-safe capability if the conduit should be fractured from the outside. This conduit may also be designed to serve as an electrical raceway.

The principal objects of the present invention are to provide an improved furnace or heating apparatus design and control system which: (a) provides improved steady-state and seasonal efficiency as compared to conventional natural draft furnaces; (b) utilizes an induced draft blower, an exhaust gas flow restriction, and an exhaust gas pressure differential feedback signal to control burner fuel flow; (c) utilizes exhaust gas differential pressure sensing to reduce high excess air combustion conditions, particularly when the furnace is derated; and (d) utilize a modulating gas valve responsive to differential pressure signals and including a flapper valve threshold mechanism to provide hysteresis in the on-off cycle of the gas valve.

BRIEF DESCRIPTION OF THE DRAWINGS

In the accompanying drawings forming a material part of this disclosure.

DESCRIPTION OF THE INVENTION

Figure 1:
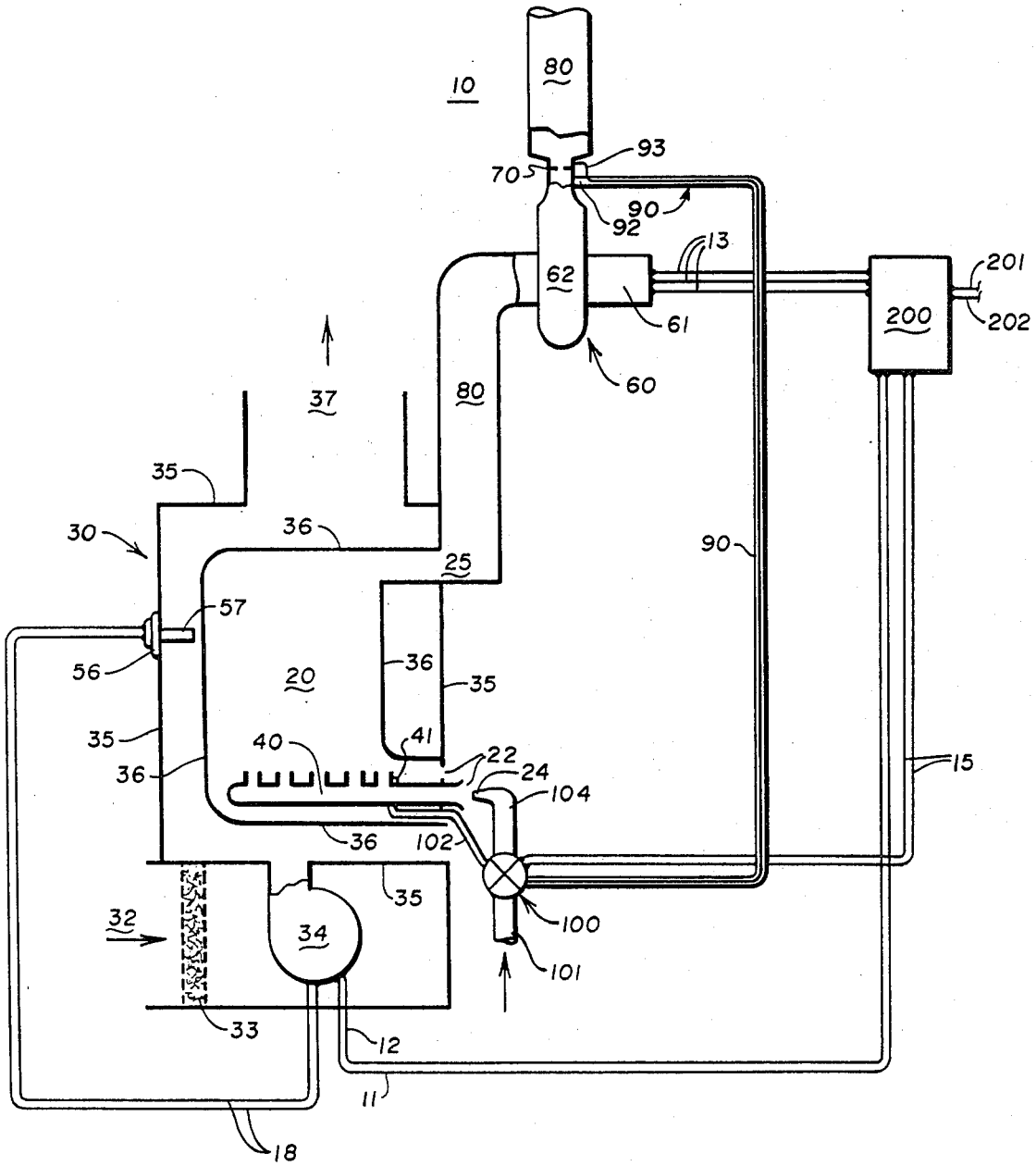
FIG. 1 is a schematic drawing of the furnace and the basic control system of the present invention, using an orifice downstream from the induced draft blower and a differential pressure feedback signal.

Description of Preferred and Alternate Embodiments a. General Configuration of Furnace and Control System A furnace and furnace control system 10 in accordance with the present invention consists generally, as shown in FIG. 1, of one or more combustion chambers 20, each of which has a burner 40 located near its bottom and is substantially enclosed by exterior walls 36. Fuel, which in the preferred embodiment is a gas such as natural gas or liquified petroleum, is fed to the burner 40 by a gas outlet 24 near the mouth of the burner 40. Air enters the burner 40 and the combustion chamber 20 at air inlets 22, located near the tip of the gas outlet 24 and the mouth of the burner 40. A pilot flame 41 positioned immediately adjacent the burner 40 is used to ignite it.

Surrounding the combustion chamber (or chambers) 20 is a heat exchanger 30 with its interior boundary being formed by the exterior walls 36 of the combustion chamber 20 and its exterior boundary being formed by the walls 35. Thus two separate fluid paths are formed. The combustion chamber path leads from the gas outlet 24 and air inlets 22 through the burner 40 and out the flue 25. The heat exchanger path follows the exterior walls 36 of the combustion chamber 20, with the fluid to be heated entering below the burner 40, proceeding along the vertical portion of the enclosed area between the walls 35 and the exterior burner wall 36 to exit above the combustion chamber 20. While in the preferred embodiment air is the fluid to be heated, other fluids, such as water, may also be used with minor design changes.

As is conventional, movement of air into and through the heat exchanger 30 is provided by a circulating fan or blower 34 driven by an electric motor 38 (not shown in FIG. 1). Cold air is pulled into the heat exchanger 30 at a cold air return duct 32 and passes through an air filter 33 before it enters the fan 34. The fan 34 drives the air into the heat exchanger 30 through an opening in its bottom wall. Heated air passes out of the heat exchanger 30 through a warm air duct 37, which extends from an opening in the top wall of the heat exchanger 30.

With the exception of the flue 25 and the combustion air inlets 22 adjacent the gas outlet 24, the combustion chamber 20 is enclosed and substantially air-tight. Accordingly, the only exit for combustion materials is provided by the flue 25. In order to induce air to enter the combustion chamber 20 at the combustion air inlets 22 and to induce combusted gases to exit from the combustion chamber 20 and flow out the flue 25 and exhaust stack or vent 80, an induced draft blower 60 is used. This induced draft blower 60, with its electric motor 61 and fan blades 62, is located in line with the flue 25 and the exhaust stack or vent 80. Electric power is supplied to the motor 61 by a line voltage source, indicated by wires 13.

Means are provided to control the flow rate of exhaust gas out the stack 80. Although flow control could be achieved by adjustment of a damper in the exhaust path, in the preferred embodiment exhaust gas flow control is exercised by controlling the speed of the motor 61 of the blower 60. The preferred blower 60 has at least two speeds, depending on the type of control system with which it is to be used. While blowers of various specifications may be used, in the preferred embodiment the blower 60 is two-speed and is powered by 120 volts a.c. At high speed, it produces 1 inch W.C. minimum pressure (relative to atmosphere) at 450 degrees Fahrenheit, at a flow rate of about 50 c.f.m. At low speed, it delivers approximately 25 c.f.m.

The fluid fuel is provided to the burner 40 at the gas outlet 24, fed by the outlet pipe 104 of a differential pressure sensitive modulating gas valve, or means for changing the fuel supply 100, which serves as a primary element of a fuel supply control means. Gas from a supply maintained at line pressure enters the gas valve 100 at a gas inlet pipe 101. Gas regulated to the desired outlet pressure flows out of the gas valve 100 through the outlet pipe 104. The pilot flame 41 is supplied with gas at line pressure by a smaller outlet pipe 102. The detailed structure and operation of the gas valve 100 which permits it to regulate gas to the desired pressure is described below.

Figure 2A:
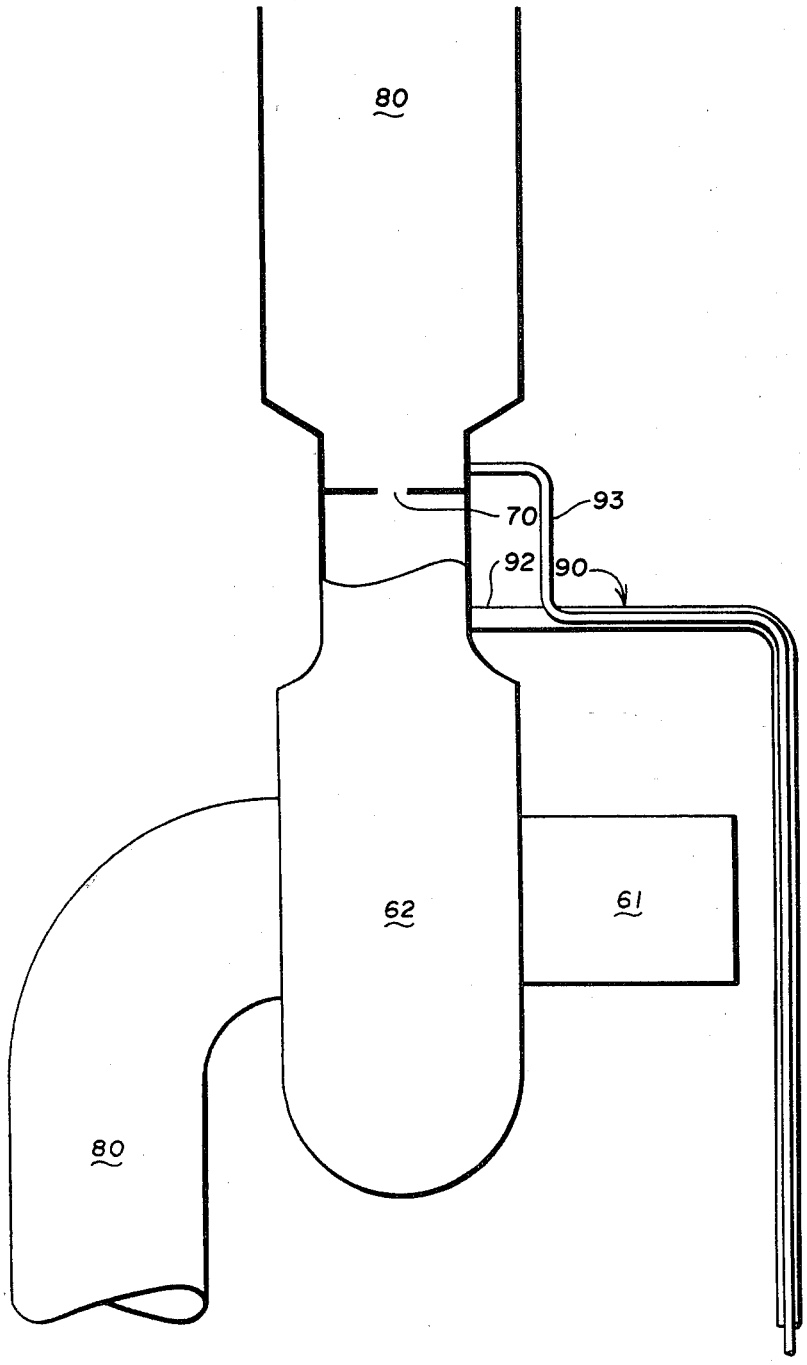
FIG. 2*a* is a detail of the induced draft blower, the exhaust stack and stack orifice and the multi-chambered conduit used to communicate differential pressure signals to the modulating gas valve, with the stack orifice located downstream from the blower.

Referring also to FIG. 2*a*, a multi-chambered feedback conduit which is made up of two passages or tubes 92, 93, one located within the other, communicates a stack or exhaust gas differential pressure signal back to the modulating gas valve 100. Each of the tubes 92, 93 is connected to and through the wall of the stack 80. The interior tube 93, which is preferably concentric with the exterior tube, communicates a pressure sensed on the downstream side of the orifice 70, while the exterior tube 92 communicates a pressure sensed on the upstream side, as best seen in FIG. 2*a*. As is described below, this differential pressure feedback signal, communicated via the conduit 90, is used to turn on and off and to modulate the outlet gas pressure and, thus, the fuel flow rate, from the valve 100.

FIG. 1 also shows in a general, schematic manner, the electrical interconnections between the various components forming the furnace control system. Coordination of the control system is provided by a thermostatic control 200 which includes various temperature-sensitive components and switching elements, as will be described in greater detail below in connection with FIG. 4. These components and switching elements serve as the means for controlling operation of the blower 60 and for enabling the gas valve 100. Power to the thermostatic control 200 is provided by connections to a line voltage source, indicated by wires 201, 202.

The thermostatic control 200 is electrically connected to the motor 61 of the stack blower 60 via wires 13. As is decribed in greater detail below, it is this connection which permits the thermostatic control 200 to turn the blower motor 61 on and off and to switch the blower 60 between a first speed and a second speed.

The thermostatic control 200 is further electrically connected to the gas valve 100, via wires 15. It is this connection which permits the thermostatic control 200 to ensure that gas is available from the gas valve 100 to the gas outlet pipe 104 and the pilot outlet pipe 102 only when desired.

The fan 34 which circulates air through the heat exchanger 30 is provided with power by line voltage connections 11 and 12. The fan motor 38 (FIG. 4; not shown in FIG. 1) is electrically connected, via wires 18, to a fan limit control switch 56 which is driven by a temperature sensitive element 57, such as a bimetal thermostat. This temperature sensitive element 57 causes the circulating fan motor 38 to be switched on when the air temperature in the heat exchanger 30 rises above a predetermined temperature (fan-start setpoint) and to be switched off when the temperature of the air in the heat exchanger 30 sinks below a predetermined temperature (fan-stop setpoint). One suitable temperature sensitive switch for this purpose is the L4064 fan and limit switch manufactured by Honeywell Inc., of Minneapolis, Minn. Because one purpose of the fan limit control switch 56 is to delay fan start-up until the heat exchanger 30 contains air at or above a predetermined temperature, a time-delay mechanism could be substituted for the temperature sensitive element 57. This mechanism could be activated at the same time as the blower motor 61, but it would delay fan start-up for a predetermined period sufficient to let the heat exchanger 30 reach the predetermined temperature.

b. Modulating Gas Valve

Figure 3A:
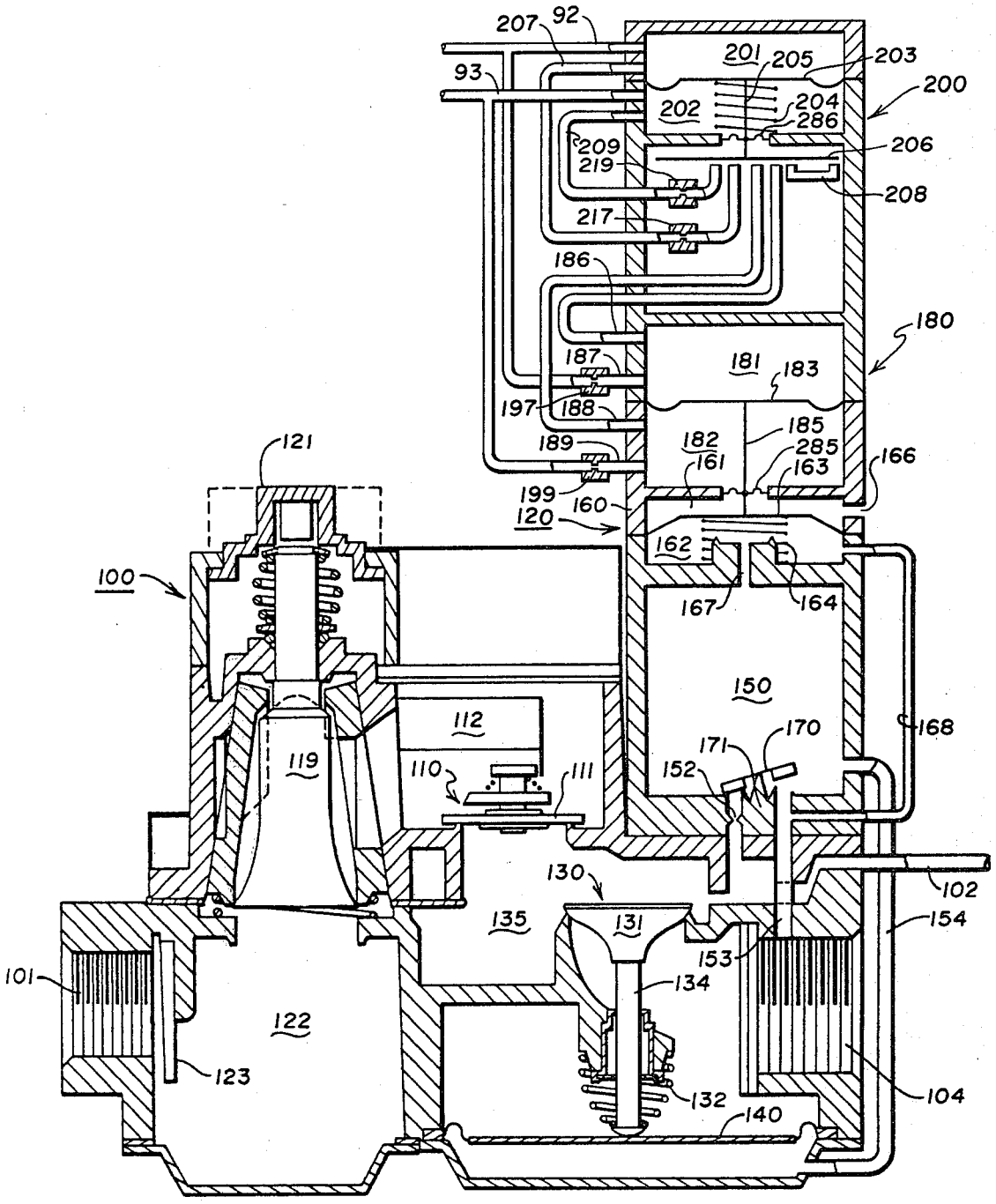
FIG. 3*a* is a schematic diagram of the differential pressure sensitive modulating gas valve used in the present invention shown in the "off" position.
Figure 3B:
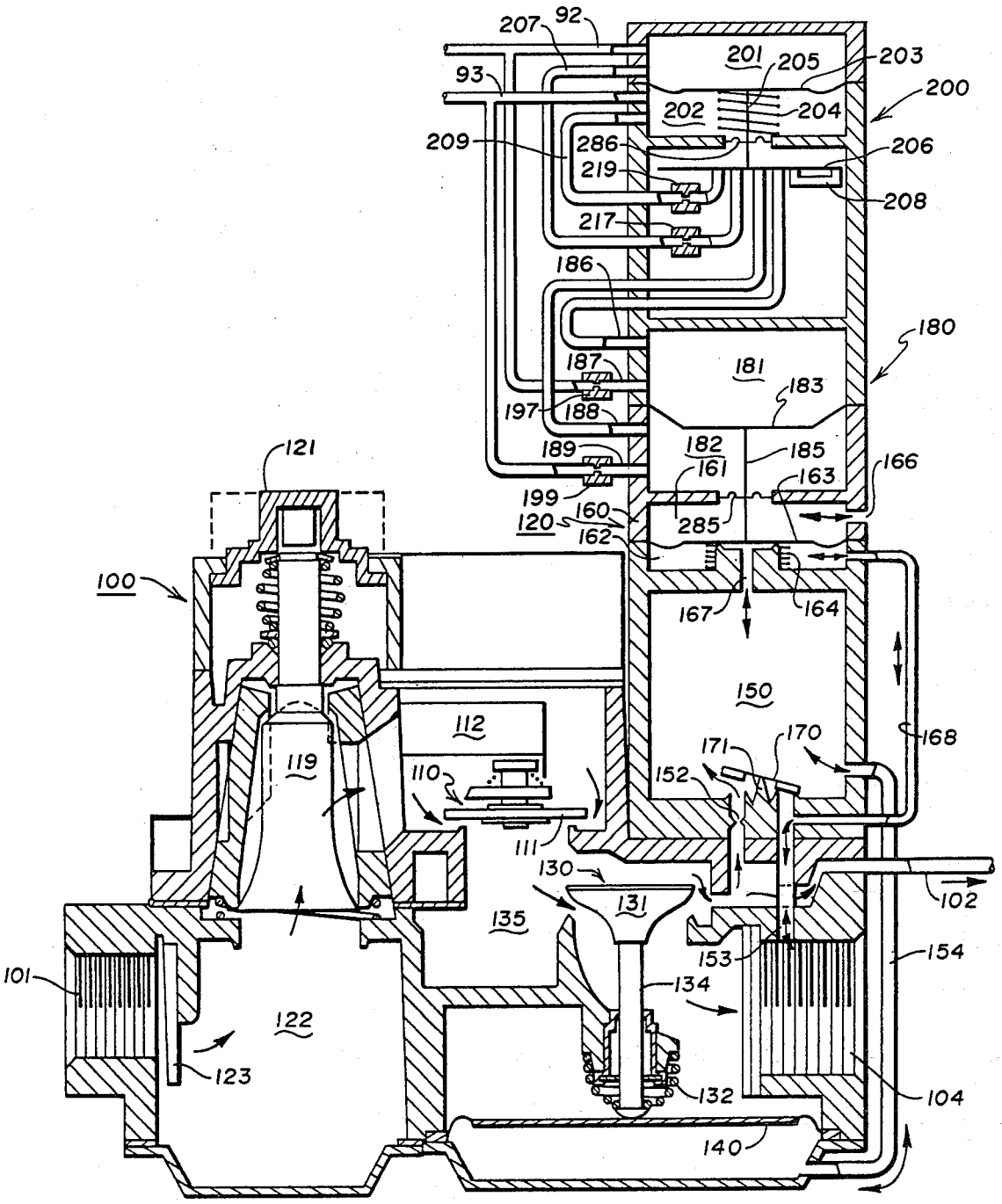
FIG. 3*b* is a schematic diagram of the differential pressure modulating gas valve used in the present invention shown in the "on" position.

Schematically shown in FIGS. 3*a* and 3*b*, is the detailed structure of the preferred embodiment of the pressure modulating gas valve 100, including its connections to various other parts of the furnace system. In the preferred embodiment, this valve is a redundant, modulating gas valve, such as the Model VR 860 valve manufactured by Honeywell Inc. with its conventional configuration significantly modified to incorporate a differential pressure (d.p.) flapper valve section cooperating with a d.p. gas regulator section, which, in turn, cooperates with a d.p. servo-regulator section. Referring now to FIG. 3*a*, which shows the gas valve 100 in the "off" position, it is seen that the fuel gas supply (at line pressure, typically 7 to 10 inches W.C.) enters the valve 100 via a gas inlet pipe 101, while the pressure-regulated outlet gas leaves the valve to flow to the burner 40 through the outlet pipe 104. The gas valve 100 is made up of several components. These can generally be divided into a first main valve 110, a second main valve 130, a d.p. flapper valve section 200, a d.p. gas regulator section 180 and a d.p. servo-regulator valve section 120. The first main valve 110 opens and closes by means of a valve disc 111 which is actuated by a solenoid mechanism 112. When this first main valve 110 is open (FIG. 3*b*), gas is permitted to flow into the region above the second main valve 130 and also to the pilot outlet pipe 102.

The gas valve 100 has an inlet chamber 122, which is located below a manually-actuated on-off valve 119 controlled by the knob 121. Gas can enter the inlet chamber 122 by flowing under the dirt barrier 123 and upwards toward the first main valve 110. After passing the first main valve 110, the gas will enter the second main valve chamber 135, which contain a second main valve disc 131 mounted via a stem 134 on a second main valve spring 132, which biases the second main valve 130 into a closed position. The lower end of the stem 134 of the main valve disc 131 bears against a main valve diaphragm 140.

The d.p. servo-regulator valve section 120 comprises an operator valve chamber 150 which accommodates a seesaw-like operator valve 170 actuated by a suitable electromagnetic actuator 171. Located above the operator valve chamber 150 is a servo pressure regulator chamber 160, divided into an upper portion 161 and a lower portion 162 by a regulator diaphragm 163. The regulator diaphragm 163 is supported by a spring 164.

Other important structural features of the regulator valve section 120 include a working gas supply orifice 152 in a conduit communicating between the operator valve chamber 150 and the chamber 135 above the second main valve 130. The upper portion 161 of the regulator chamber 160 is exposed to atmospheric pressure by means of a vent opening 166. Accordingly, the pressure in the upper portion 161 of the regulator chamber 160 will always be atmospheric pressure, while the pressure in the lower portion 162 will vary in accordance with the position of the diaphragm 163 relative to the opening at the end of the passageway 167 and with the pressure present in the operator valve chamber 150.

Above the d.p. regulator valve section 120 is located the d.p. gas regulator section 180, which comprises a d.p. regulator chamber divided into an upper portion 181 and a lower portion 182 by a diaphragm 183. The diaphragm is not directly balanced by any springs but, rather, assumes its rest position based on its own configuration and resilience and based on its connection to the spring-balanced diaphragm 163 via a rigid rod 185. One end of the rod 185 is attached to the center of the diaphragm 163, while the other end is attached to the center of the diaphragm 183. The rod 185 is movably mounted by means of a small, flexible diaphragm 285 for transmitting motion so that it moves up and down freely with the up and down motion of the two diaphragms 163, 183 and the spring 164 associated with the diaphragm 163.

The pressures obtaining in the upper and lower portions 181, 182 of the d.p. regulator chamber are controlled by four conduits 186, 187, 188, 189 which are connected to the chamber. One end of the conduit 187 is connected to the exterior passage 92 of the feedback conduit 90; the other end is connected to the upper portion 181 of the d.p. gas regulator section 180. One end of the conduit 186 is connected to this same upper portion 181; the other end is open to the atmosphere except when sealed by the flapper valve plate 206 (as described below).

Conduits 188 and 189 are connected to the lower portion 182 of the d.p. gas regulator section 180. One end of the conduit 189 is connected to the interior passage 93 of the feedback conduit 90; the other end is connected to the lower portion 182. One end of the conduit 188 is connected to this same lower portion; the other end is open to the atmosphere except when sealed by the flapper valve plate 206 (as described below). It should be noted that both of the conduits 187, 189 with connections to the feedback conduit 90 have small flow-limiting orifices 197, 199, respectively, near their connection points to the d.p. gas regulator section 180.

Above the d.p. gas regulator section 180 is located the d.p. flapper valve section 200, which comprises a differential pressure chamber divided into an upper portion 201 and a lower portion 202 by a diaphragm 203, supported on a spring 204. In addition, the flapper valve section 200 includes a rigid rod 205 which is connected to the diaphragm 203 at one end and to a flapper valve plate 206 at the other end. The rod 205 is movably mounted by means of a small, flexible diaphragm 286 for transmitting motion so that it moves up and down freely with the up and down motion of the diaphragm 203 and the spring 204.

The pressures obtaining in the upper and lower portions 201, 202 of the d.p. flapper valve section 200 are controlled by the exterior and interior passages 92, 93, respectively, of the feedback conduit 90 and by the conduits 207, 209 which are connected to the d.p. flapper valve section 180. The passage 92 is connected to the upper portion 201 of the d.p. flapper valve section 200, while the passage 93 is connected to the lower portion 202. One end of the conduit 207 is connected to the upper portion 201 of the flapper valve section 200; the other end is open to the atmosphere except when sealed by the flapper valve plate 206 (as described below). One end of the conduit 209 is connected to the lower portion 202 of the flapper valve section 200; the other end is, smaller to the conduit 207, open except when sealed by the flapper valve plate 206. It should be noted that both the conduits 207, 209, which are open to the atmosphere except when sealed by the flapper valve plate 206, have small flow-limiting orifices 217, 219, respectively, near their respective ends adjacent the flapper valve plate 206.

The length of the rod 205 and the size of the spring 204 are chosen such that when the diaphragm 203 is in its equilibrium position, with no pressure differential exerted on it, the flapper valve plate 206 does not sealingly engage or significantly obstruct gas flow from the conduits 186, 188, 207 or 209. The spring force of the spring 204 is chosen or adjusted by a suitable screw adjustment (not shown) such that when a predetermined pressure differential exists, with the pressure in the upper portion 201 of the d.p. flapper valve section exceeding the pressure in the lower portion 202, the diaphragm 203 will be displaced and the flapper valve plate 206 will be driven downward so as to sealingly engage and close off the ends of the conduits 186, 188, 207 and 209.

A small magnet 208 located below and adjacent the flapper valve plate 206 is used to provide hysteresis for the opening and closing of the conduits 186, 188, 207 and 209. The flapper valve plate 206 itself is made of a magnetic material, such as iron, preferably covered on its lower side with a thin layer of rubber or other resilient material to improve sealing against the ends of conduits 186, 188, 207 and 209. The location of the magnet 208 is chosen such that its two poles are aligned with each other and with the ends of the conduits 186, 188, 207 and 209.

Thus, when the flapper valve plate 206 engages the ends of these conduits it also engages and is held by the magnet 208. The strength of the magnet 208 must be chosen such that its attractive force can be overcome by the upward force of the spring 204 on the diaphragm 203 when the pressure differential no longer drives the flapper valve plate 206 against the conduit ends.

c. Control System

Figure 4:
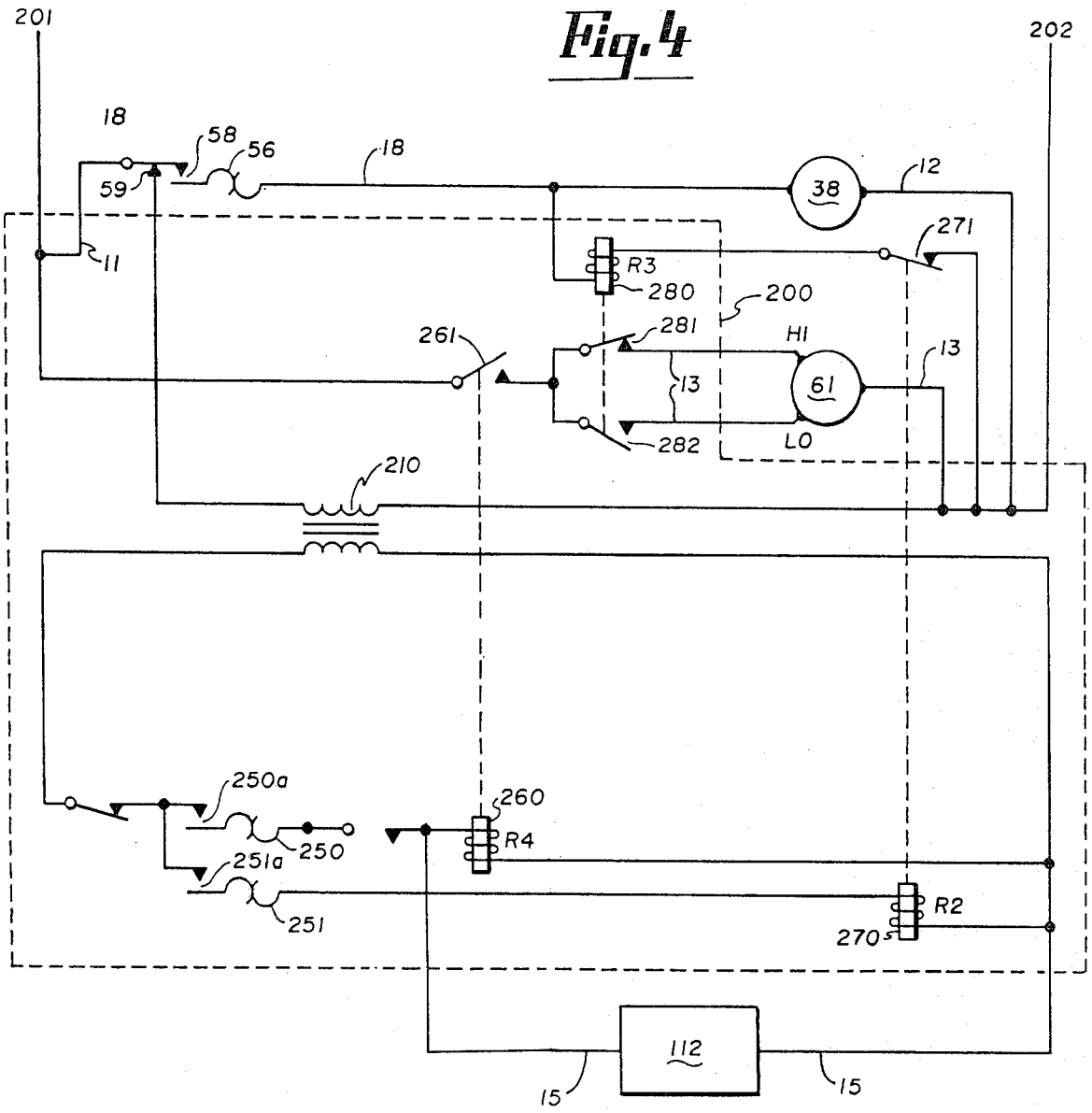
FIG. 4 is an electrical schematic of a two-stage thermostat control system used in connection with the present invention.

Shown in FIG. 4 is an electrical schematic of the thermostatic control 200 associated with the present invention. This schematic illustrates the components which would be contained within the thermostatic control 200 and also those electrically connected thereto, such as the electric motors 38, 61, and the fan control switch 56. The thermostatic control 200 has two stages, with two thermostat elements 250, 251 (such as in Honeywell Inc. thermostat model T872F). Line voltage power is provided on wires 201 and 202. This line voltage is used to power the circulating fan motor 38, to which it is connected via the wires 11, 12, 18 and the normally open main contacts 58 of the fan limit control switch 56. In an electrical path parallel to the fan motor 38 are the coil for the R3 relay 280 and a normally closed pair of contacts 271 actuated by the R2 relay 270. Also powered by the line voltage, via the three wires 13, is a two-speed draft blower motor 61. The parameters of the blower 60, including its effective flow rates at higher and lower speeds, are chosen so that the furnace will operate at substantially its design maximum when the blower motor 61 is on its higher speed. The lower speed of the blower motor 61 is chosen to produce a firing rate less than the design maximum for the furnace. Typically, the lower firing rate will be on the order of 50% to 70% of the design maximum.

Normally open relay contacts 261 actuated by R4 relay 260 are in series with the blower motor 61. The high speed circuit to the blower 61 is controlled by normally closed contacts 281 actuated by R3 relay 280, while the low speed circuit for the blower 61 is controlled by normally open contacts 282, also actuated by R3 relay 280. The contacts 282 close when the contacts 281 open, and vice versa. Voltage at an appropriate level for the room thermostat portion of the control, in the preferred embodiment 24 volts a.c., is provided by the secondary of the transformer 210, which is powered on its primary side by line voltage.

As seen in FIG. 4, there are two different temperature-actuated circuits in parallel with the secondary side of the transformer 210. The first circuit includes a bimetal-mercury thermostat element 250 with contacts 250*a* connected in series with the coil of the R4 blower control relay 260 which, in turn, is connected in parallel with the solenoid actuator 112. Contacts 261 are driven by the R4 relay 260.

In the second temperature-actuated circuit connected in parallel to the secondary side of transformer 210 is a second bimetal-mercury thermostat element 251 with contacts 251*a*, which is connected in series with the coil for R2 relay 270, driving the normally-closed contacts 271. The bimetal element 251 is set to close its contacts at a slightly lower temperature (e.g. 2–3 degrees Fahrenheit) than the actuation temperature for the other bimetal element 250. As will be described in greater detail below, the function of this second temperature-actuated circuit is to switch the blower motor 61 between its higher and lower speeds under certain circumstances, by controlling the power to the coil of the R3 relay 280.

An additional element of the control system is normally closed contacts 59, in series with the primary side of the transformer 210. Contacts 59 are opened by fan limit control switch 56 at a predetermined temperature (shutdown setpoint), corresponding to a dangerously high heat exchanger temperature.

d. Alternate Embodiments and Features

Figure 2B:
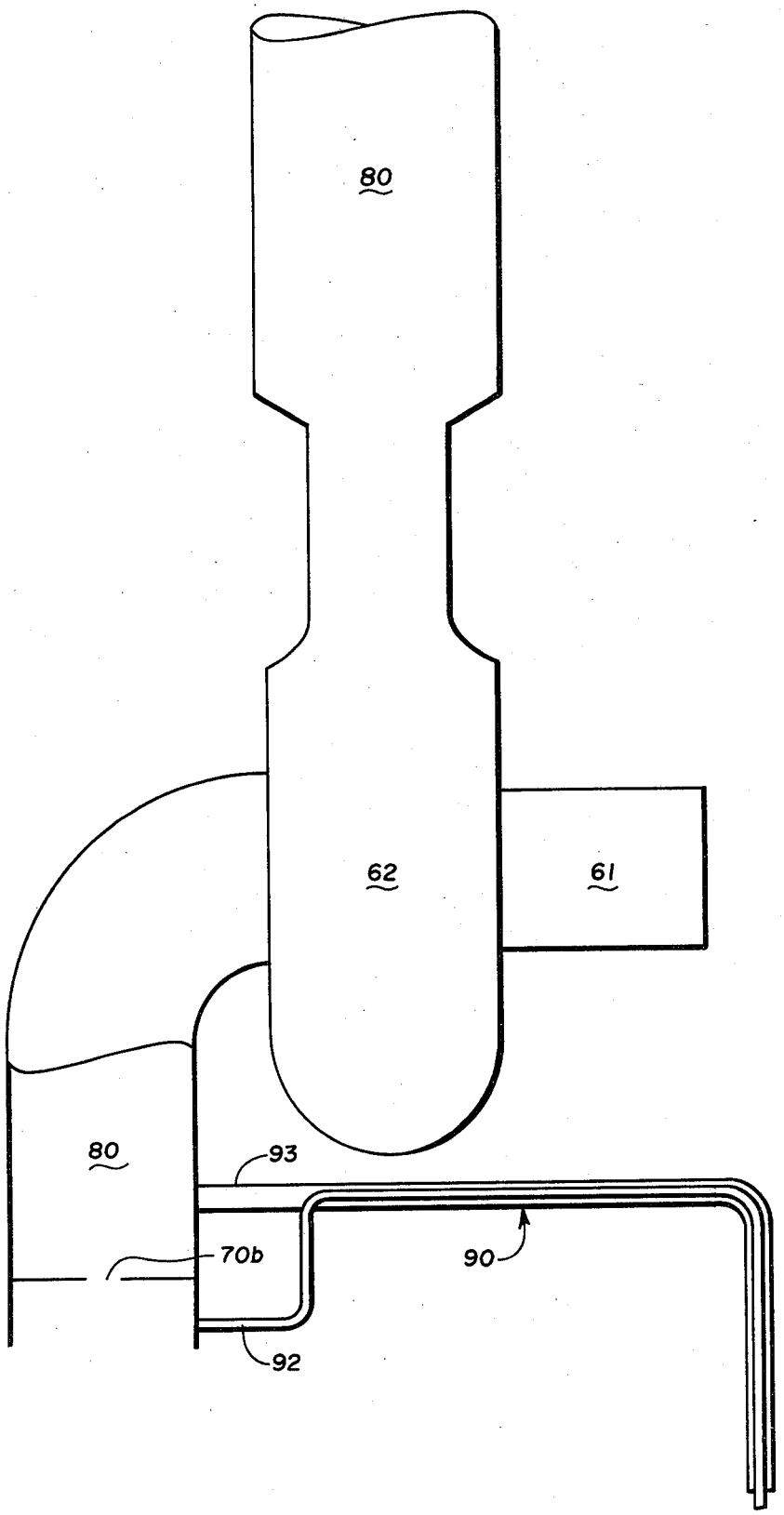
FIG. 2*b* is a detail of the induced draft blower, the exhaust stack and stack orifice and the multi-chambered conduit used to communicate differential pressure signals to the modulating gas valve, with the stack orifice located upstream from the blower.

FIG. 2*b* discloses an alternative embodiment of the arrangement for obtaining and communicating the differential pressure signal which is fed back to the modulating gas valve 100. As shown in FIG. 2*b*, a flow limiting orifice 70*b* can be placed upstream from the blower 60. If this is done, the pressure differential across the orifice 70*b* is created by a suction effect, rather than by a pressure buildup effect, as in the arrangement shown in FIG. 2*a*. Because the valve 100 responds to a pressure differential, it can be used without change with a suction-based arrangement, as long as the higher pressure is conveyed in the passage 92, while the lower pressure is conveyed in the passage 93, of the conduit 90. However, with this embodiment the passage 92 should be within the passage 93 (as shown in FIG. 2*b*) to take advantage of a fail-safe feature described below.

The conduit 90 has been previously described as comprising a pair of passages or tubes 92, 93, one smaller than and located within the other, preferably concentrically. In fact, the conduit 90 can be embodied in a simpler form in which the passages are not concentric, as long as free flow within each of the two passages 92, 93 is maintained.

Figure 5:
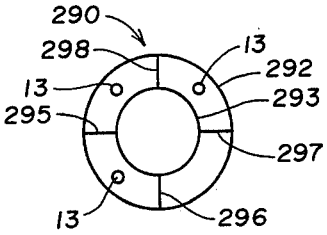
FIG. 5 is a cross sectional view of an alternate embodiment of the multi-chambered conduit used to communicate differential pressure signals in the present invention, as adapted to also serve as an electrical raceway.

As shown in FIG. 5, the conduit 90 can also take on a configuration which is especially adapted to serve as an electrical raceway as well as a means for communicating differential pressure signals. As seen in FIG. 5, which depicts a cross-sectional view of a specially adapted feedback conduit 290, a conduit may be constructed of two concentric tubes 292, 293, with the exterior of the interior tube 293 connected to the interior of the exterior tube 292 by four webs 295, 296, 297, 298 which run longitudinally, approximately equidistant from each other, the full length of the conduit 290. Such a cross-section can be produced by extruding plastic or metal in the form shown.

With a conduit 290 of this configuration the wires 13 of the blower motor 61 can be accommodated within three of the longitudinal passages between the four webs 295, 296, 297, 298, with the fourth longitudinal passage and the interior tube 293 reserved for communicating the differential pressure signals. If greater or fewer wires 13 are required for the blower motor 61, (e.g. with a single speed blower only two wires are required) then the number of webs can be varied accordingly.

With the conduit shown in FIG. 5, as with the two-passage conduit discussed previously, the exterior passage 92 or 292 should be used to convey the upstream exhaust gas pressure, which is normally greater than or equal to the downstream pressure in arrangements such as in FIG. 2*a*. (In arrangements such as that shown in FIG. 2*b*, a suction pressure is developed and the downstream pressure is normally less than or equal to the upstream pressure. In this case, the exterior passage should convey the downstream pressure. Thus, the index numbers 92, 93 in FIG. 2*b* are reversed as compared to FIG. 2*a*.) The reason for this is that should a fracture occur in the conduit, it will most likely occur in the outer layer, e.g., as a result of an external blow. Such a fracture will cause the pressure in the exterior passage to go to atmospheric pressure, sharply reducing the pressure differential. The flapper valve plate 206 will unseal from the conduits 186, 188, 207, 209 and the flow of gas will be cut off to shut down the furnace safely. The same type of shutdown will occur should a fracture affect both the interior and exterior passages.

Operation of Preferred and Alternate Embodiments

The operation of the present invention can best be understood in terms of three interrelated sequences of operation. The first two sequences of operation concern the functioning of the modulating gas supply valve 100. The third sequence concerns the functioning of the control system 200.

The gas valve 100 is designed to produce an outlet gas pressure which is modulated in accordance with the magnitude of a differential-pressure signal sensed at the stack orifice 70 or 70*b* (FIG. 2*b*). In particular, the valve 100 is intended to produce an outlet gas pressure which is linearly proportional to the magnitude of the pressure differential sensed in the region of the stack 80 near the blower 60 and stack orifice 70 or 70*b* (FIG. 2*b*). As shown in FIGS. 1, 2*a*, 2*b*, 3*a* and 3*b*, this pressure differential is sensed and fed back to the gas valve 100 by means of a conduit 90, comprised of two passages 92, 93 each of which is connected at one end to and through the wall of the exhaust stack 80. The passage 92 is connected just upstream from the stack orifice 70, 70*b*; the passage 93 is connected just downstream. At their other ends, the passages 92, 93 communicate with the two differential pressure chambers of the d.p. gas regulator section 180 and the d.p. flapper valve section 200, as shown in FIGS. 3*a* and 3*b* and explained in greater detail above.

It should be noted that although the preferred and alternate embodiments described have control systems which rely on pressure feedback signals to control an outlet gas supply pressure, this is only one type of feedback signal which could be used to modulate a fuel supply rate and obtain an air-fuel ratio approximating stoichiometric combustion. The molecular ratios of fuel and oxygen desired for stoichiometric combustion are translatable into mass ratios which correspond, in the case of moving fluids in a continous combustion process, to mass flow rates. Given the flow-restricting geometry of the orifices 70 or 70*b*, for a given exhaust gas temperature, the mass flow rates correspond to exhaust gas pressures measured adjacent the orifices. In particular, the greater the pressure differential across a flow-restricting orifice of a given size, the greater the mass flow through the orifice. In fact, at constant temperature, mass flow is proportional to the square root of the pressure difference. For this reason, it is possible to use the relationship between pressures sensed at appropriate locations as a substitute for direct sensing of mass flow rates. However, it should be clear that the present invention can be implemented by sensed parameters other than pressure, which also correspond to exhaust gas flow rates, and by using the sensed parameters to control fuel delivery rate parameters other than gas supply pressure, although the following discussion of operation specifically discusses a pressure-oriented control system.

a. Operation of Modulating Gas Valve—Flapper Valve Section

As best seen in FIG. 3*a*, the diaphragm 203 of the d.p. flapper valve section 200 is exposed to the pressures communicated by the passages or tubes 92, 93 which communicate the pressure differential present across the stack orifice 70. (In the following, reference will be made to the embodiment of FIG. 2*a*. The explanation applies also to the embodiment of FIG. 2*b*, mutatis mutandis.) The pressures introduced into the upper and lower portions 201, 202 of the d.p. flapper valve section by the tubes 92, 93 will be somewhat dissipated by leakage out through the conduits 207, 209 to the atmosphere, but this pressure dissipation will be slight due to the small flow-restricting orifices 217, 219 located at the ends of the conduits 207, 209. Slight pressure dissipation may also occur through the conduits 187 and 189 which are connected to tubes 92, 93, respectively, but, again, small orifices 197, 199 located near the outlets of the conduits, reduce this dissipation sharply. As a result, the pressure differential which obtains in the d.p. flapper valve section 200, will be substantially equal to the pressure differential across the orifice 70 and be an indicator of exhaust gas flow through the orifice 70. (By contrast, any differential pressure which might be communicated to the upper and lower portions 181, 182 of the d.p. gas regulator section 180 is dissipated through the conduits 186, 188 which do not have flow-restricting orifices.)

When the furnace is turned off, the differential pressure across the orifice 70 is zero. As the blower 60 starts up and begins to move air through the orifice 70, the pressure differential will increase from zero as the pressure in the upper portion 201 of the d.p. flapper valve section 200 rises. At some predetermined magnitude of pressure differential (1.0 inches W.C. in the preferred embodiment), the force of the spring 204 will be overcome such that the diaphragms 203 and 286, the rod 205 and the flapper valve plate 206 are driven downward so that the flapper valve plate 206 sealingly engages the ends of the conduits 186, 188, 207 and 209 and comes into contact with the poles of the magnet 208. The effect of this is to stop all flow through the conduits 186, 188, 207 and 209. This causes the differential pressure communicated by the passages 92, 93 to come to bear in the upper and lower portions, respectively, of the d.p. gas regulator section 180, due to their connection with the conduits 187, 189. This invokes the operation of the d.p. gas regulator section 180 and the servo-regulator section 160 as discussed below.

Operation of the d.p. flapper valve section 200 is designed to provide a hysteresis when the blower 60 is turned off and the differential pressure across the orifice 70 decreases. As the pressure differential in the d.p. flapper valve section 200 decreases, the spring 204 will urge the diaphragm 203 upward. At this point, the forces operating on the diaphragm 203 include not only the differential pressure and the spring 204 but also the magnet 208 which attracts the flapper valve plate 206. The additional attractive force of the magnet 208 makes the pressure differential at which the flapper valve plate 206 unseals the ends of the conduits 186, 188, 207 and 209 less than the pressure differential required to overcome the spring 204 to seal these conduits. In the preferred embodiment this lower pressure differential is 0.9 inches W.C. When the flapper valve plate 206 unseals the ends of the conduits 186, 188, 207 and 209, the differential pressure in the d.p. regulator section 200 drops immediately, because the pressures are now vented to atmosphere through the conduits 186, 188.

b. Operation of Modulating Gas Valve-Regulator Sections

As best seen in FIG. 3*a*, showing the gas supply valve 100 in the "off" position, in normal operation there are several closure points which affect the flow of gas through the gas supply valve 100. The first main valve 110 is connected via the pipe 101 and the inlet chamber 122 to the external gas supply at line pressure and can, by itself, prevent gas from flowing into the remainder of the gas supply valve 100. Accordingly, opening of the first main valve 110 is a prerequisite to any flow of gas from the outlet pipe 104. Because other closure points in the valve 100 can also independently prevent flow of outlet gas, the type of valve used in the present invention can incorporate improved safety features and is termed "redundant." Several conditions must be met before the valve 100 permits gas to flow to the burner 40.

The first main valve 110 also controls the supply of gas to the pilot outlet pipe 102. Thus, the burner 40 has an intermittent pilot. Once the first main valve 110 is open, gas can flow to the pilot 41 and also into the second main valve chamber 135.

Gas entering the gas supply valve 100 flows into the inlet chamber 122 and then flows under a dirt barrier 123, which is designed to deter foreign particles from entering the remainder of the valve. A knob 121 connected to a manually-actuated valve 119 located above the inlet chamber 122 can be used to manually open and close the flow of gas from the inlet chamber 122. This valve 119 is typically closed only in exceptional situations, not during normal operation. After passing under the dirt barrier 123 and through the first main valve 110, the gas flows into a chamber 135 located above the second main valve 130. From this chamber 135, the gas can flow to the pilot outlet pipe 102 and in one or two other directions. If the second main valve 130 is open, the gas can flow into a region above the main valve diaphragm 140 and into the outlet gas pipe 104. If the second main valve 130 is not open, the gas will tend to flow up through the working gas supply orifice 152 toward the operator valve chamber 150. This flow will be significantly restricted by the narrow orifice 152, across which there may exist a pressure gradient. However, no gas will enter the operator valve chamber 150 at all when the operator valve 170 closes the conduit which includes the orifice 152, as shown in FIG. 3*a*. Only when the operator valve 170 opens this conduit, as shown in FIG. 3*b*, can gas enter the operator valve chamber 150 from the chamber 135 and flow upward toward the servo pressure regulator chamber 160.

Gas will enter the lower portion 162 of the servo pressure regulator chamber 160 only when the regulator diaphragm 163 is not pressed down so as to sealingly engage the regulator orifice 167. When the orifice 167 is closed as shown in FIG. 3*b*, gas cannot enter the lower portion 162 of the servo pressure regulator 160, except from the outlet pipe 104, by means of the narrow conduit 168 (as discussed below). Once the orifice 167 is open, gas can flow between the operator valve chamber 150 and the lower portion 162 of the servo pressure regulator chamber 160. Gas which enters the lower portion 162 of the servo pressure regulator chamber 160 can escape only via the conduit 168, which leads to the outlet gas pipe 104, or by flowing back into the operator valve chamber 150. It should be noted that the lower portion of the conduit 168 connects with a conduit 153, which communicates between the operator valve chamber 150 and the outlet gas pipe 104 when the operator valve 170 is in the "off" position FIG. 3*a*). Accordingly, when the operator valve 170 is "off" as shown in FIG. 3*a*, gas can flow directly between the operator valve chamber 150 and the outlet gas pipe 104. However, when the operator valve 170 is in its "on" position, as shown in FIG. 3*b*, gas cannot flow directly between the operator valve chamber 150 and the outlet gas pipe 104. The position of the operator valve 170 does not, of course, directly limit the flow of gas between the lower portion 162 of the servo pressure regulator 160 and the outlet gas pipe 104 via the conduit 168, because it closes only one end of the conduit 153.

Gas which flows into the operator valve chamber 150 can also escape from this chamber into the conduit 154 which leads to the region below the main valve diaphragm 140. As can be seen best in FIG. 3*b*, gas pressure in the region below the main valve diaphragm 140 presses upward on the main valve diaphragm 140 against the force of the second main valve spring 132 to raise the second main valve disc 131. Because the surface area of the diaphragm 140 is relatively large, gas pressure in the region below the diaphragm 140 has a mechanical advantage as against the gas pressure in the chamber 135 when the second main valve 130, with its disc 131 of smaller surface area, is closed.

To regulate the outlet gas pressure to be proportional to the differential pressure which is communicated via the conduits 187, 189 to the upper and lower portions 181, 182, respectively, of the d.p. gas regulator section 180, the various valve components function as follows, as shown in FIGS. 1, 2*a*, 2*b*, 3*a* and 3*b*. Assuming that the burner 40 has been off for at least a short period of time and the first main valve 110 and the operator valve 170 have been closed, the various closure points will be as shown in FIG. 3*a*. This is because any excess (greater than atmospheric) pressure will have been dissipated from the outlet gas pipe 104 and thus from the area below the second main valve 130 and below the regulator diaphragm 163. Further, because the operator valve 170 has been in its "off" position, excess pressure in the operator valve chamber 150 and below the main valve diaphragm 140 will also have been dissipated. The same atmospheric pressure will thus exist above and below the main valve diaphragm 140, in the valve operator chamber 150 and in the region 162 below the regulator diaphragm 163. Accordingly, the second main valve 130 will be forced to its closed position by the spring 132 and by any excess pressure which may remain in the chamber 135.

Because the stack blower 60 has been off, the feedback tubes and conduits 92, 93, 187, 189 and the upper and lower portions 181, 182 of the d.p. gas regulator section 180 also contain atmospheric pressure. The diaphragm 183 and the regulator diaphragm 163 assume their rest positions, as determined by the force of the spring 164. The regulator diaphragm 163 is pushed away from the regulator orifice 167, because the spring 164 is selected (or adjusted by suitable screw adjustment means, not shown) such that the differential pressure in the d.p. gas regulation section 180 must exceed the pressure in the lower portion 162 of the d.p. servo regulator section 160 by a predetermined pressure (0.2 inches W.C. in the preferred embodiment) which is less than or equal to the differential pressure level at which the flapper valve plate 206 unseats, before the regulator diaphragm 163 will close against the regulator orifice 167.

Assuming that the preceding conditions obtain, once the first main valve 110 permits gas to enter the chamber 135 above the closed second main valve 130, the gas can go no further (except to the pilot outlet pipe 102) until the operator valve 170 is opened. This will occur when its actuator 171 has been activated as a result of proof of pilot flame. (This can be done by a conventional ionized gas circuit as part of the intermittent pilot system and is not explained in further detail herein.) Upon opening of the operator valve 170, gas at line pressure flows through the orifice 152 into the operator valve chamber 150 and into the lower portion 162 of the regulator chamber 160. A small amount of gas will begin to flow into the outlet pipe 104 through the conduit 168. Gas also flows into the conduit 154 leading to the region under the main valve diaphragm 140. Pressure will begin to build in this region, tending to push the main valve diaphragm 140 upward. This gas pressure will, however, not significantly exceed the forces holding the second main valve 130 closed, because of the force of the spring 132, the high line pressure of the gas in the chamber 135 and the gas flow from the operator valve chamber 150 into the lower portion 162 of the regulator chamber 160 and out through the conduit 168.

Assuming that the blower 60 has been switched on (as explained below), as the speed of the blower 60 reaches its maximum and flow through the orifice 70 increases, a feedback differential pressure will begin to build up across the orifice 70. The flapper valve plate 206 will seal the ends of conduits 186, 188, 207, 209, causing the pressure differential to be fed back to the upper and lower portions 181, 182 of the d.p. gas regulator chamber 180 via the tubes and conduits 92, 93, 187, 189. When this feedback differential pressure exceeds the pressure below the regulator diaphragm 163 by a predetermined threshold value $P_t$, in the preferred embodiment 0.2 inches W.C., regulator orifice 167 will be closed by the diaphragm 163. (The requirement of an excess pressure of 0.2 inches W.C. serves to verify blower operation, already shown by the seating of the flapper valve plate 206.) When the orifice 167 closes, this will cut off gas flow to the conduit 168, cause an increase in the pressure in the operator chamber 150, and cause the pressure below the main valve diaphragm 140 to increase. The main valve diaphragm 140 will be pushed upward, eventually forcing the second main valve 130 to open (FIG. 3*b*). This, in turn, will cause the pressure in the outlet pipe 104, to rise, which pressure is communicated up to the lower portion 162 of the regulator chamber 160 via the conduits 153 and 168. This rising pressure in the lower portion 162 of the regulator chamber 160, augumented by the spring 164, will eventually overcome the differential pressure exerted on the diaphragm 163 via the rod 185, to reopen the regulator orifice 167. This, in turn, causes the pressures in the operator valve chamber 150 and the area below the main valve diaphragm 140 to tend to decrease, which causes the second main valve 130 to tend to close and the outlet gas pressure and the pressure below the regulator diaphragm 163 to decrease. Because the spring 164 overcomes the feedback differential pressure when the pressure below the regulator diaphragm 163 rises to within 0.2 inches W.C. of the differential pressure exerted on the regulator diaphragm 163, while the feedback differential pressure overcomes the spring 164 when it exceeds the pressure below the diaphragm 163 by more than 0.2 inches W.C., the outlet gas pressure ($P_o$), will be regulated to be substantially equal to the feedback differential pressure ($P_f$), less 0.2 inches W.C. (the threshold pressure $P_t$). Thus, $P_o = P_f - 0.2 = P_f - P_t$, where all pressures are expressed in inches W.C. and are relative to atmospheric pressure.

c. Operation of Thermostat Control Systems

Referring now to FIG. 4, the third important sequence of operation, the operation of the electrical components for the two-stage thermostat control system, which provides a high and low firing rate, is described.

When the temperature of the heated space sinks below the setpoint of the thermostat element 250 with the higher setpoint, the contacts 250*a* close and the coil of R4 relay 260 is activated, thereby causing the contacts 261 to close. Because the R3 relay 280 is not active at this point (the main contacts 58 of fan limit control switch 56 are open), the R3 relay contacts 281 are closed and the two-speed blower motor 61 comes on at high speed, corresponding to the higher firing rate of the furnace. Differential pressure begins to build in the stack 80 across the orifice 70. At the same time the R4 relay 260 is activated, the solenoid 112 of the first main valve, which is connected in parallel with the R4 relay 260, is activated. This is the first step in enabling the modulating gas valve 100. When the upstream pressure in the stack 80 differs from the downstream pressure by a predetermined amount, the flapper valve plate 206 seats against the ends of the conduits 186, 188, 207, 209, to activate the d.p. gas regulator section 180. Thus, the previously described operations sequence for the gas valve 100 commences. The pilot flame 41 gets gas and is ignited. The d.p. gas regulator and servo regulator sections 180, 160 begin to regulate the outlet gas pressure to be proportional to the feedback differential pressure ($P_o = P_f - 0.2$), as previously described.

As the burner 40 lights and the temperature in the combustion chamber 20 and the heat exchanger 30 rises, this is sensed by the temperature sensor 57 (FIG. 1) of the fan limit control switch 56. When the fan-start setpoint for this sensor is reached, the fan motor 38 is energized via the now closed contacts 58. This also energizes the R3 relay 280, causing contacts 281 to open and contacts 282 to close. This switches the blower motor 61 to low speed, corresponding to the lower or derated firing rate, in the preferred embodiment, 50% to 70% of the higher firing rate, and the burning phase continues. When the temperature in the heated space rises to the setpoint of the thermostat element 250, its contacts open and the blower motor 61 and the solenoid 112 are both deenergized. Shutdown of the fan motor 38 follows later, when the bimetal sensor 57 of the fan limit control switch 56 reaches its fan-stop setpoint, causing the main contacts 58 to open.

Should the temperature in the heated space at any time drop below the setpoint of the thermostat element 251, then the contacts 251*a* will close and the R2 relay 270 will be activated. If this occurs when the R3 relay 280 is activated (contacts 282 closed; lower firing rate), it will cause the R3 relay to be deactivated (contacts 281 closed; higher firing rate). That is, if the blower motor 61 is operating at low speed, activation of thermostat element 251 will switch it to high speed. If the R2 relay 270 is activated when the R3 relay 280 is not activated, no change in blower speed will occur. If a burning phase begins with both thermostat elements 250, 251 activated, then the R2 relay 270 will be activated and the system will not switch to the lower firing rate when the fan motor 38 is turned on. Only when the thermostat element 251 with the lower setpoint is satisfied, will the system be able to switch to the lower firing rate.

As controlled by a two-stage thermostatic control system, the present invention operates with a two-speed induced draft blower and feedback controlled fuel-gas pressure to produce a furnace with a higher and a lower firing rate. Off-cycle losses are reduced by the presence of the blower 60 and the orifice 70 in the stack 80 which allow significant draft flow, with its consequent heat loss, only during the burning phase. In addition, substantial derating can be achieved for a significant portion of the burning phase because the system switches to a lower firing rate after start-up. However, because the system always starts at the higher firing rate and maintains this rate until the heat exchanger 30 reaches a predetermined temperature (usually selected at or somewhat above the dewpoint), there is no substantial increase in condensation, which might decrease furnace life. In addition, the two-stage control system permits the furnace to stay at the higher firing rate when necessary to achieve desired temperatures under heavy heating load or to speed recovery from a period of temperature setback, such as at night.

Because the exhaust gas mass flow through the blower 60 and the orifice 70 will change with absolute temperature of the exhaust gas, the flow of combustion air into the burner 20 will be greater at start up when the exhaust gas temperature is relatively low as compared to exhaust gas temperature during steady state burning conditions. This effect will cause a higher excess air condition during start up, a condition that is desirable because the higher excess air will result in a lower dew point of the products of combustion. This will result in less condensation on the surfaces of the heat exchanger 30 as the furnace warms up. The higher excess air condition will also be noticed when the system is operating steady state at a reduced firing rate and a correspondingly reduced exhaust gas temperature. Under these circumstances, the higher excess air condition may be desirable to reduce condensation on any cold spots which might appear on the heat exchanger 30.

The above-described operation sequence may also produce a desirable effect in minimizing exhaust gas condensation within the various tubes, conduits and diaphragm chambers of the control system. The start up condition of a call for heat from the thermostats 250 and/or 251 is such that the blower 60 is energized immediately. The buildup of a differential pressure requires a definite time period, during which time the flapper valve plate 206 has no sealing effect and the various conduits which communicate pressures from the exhaust stack 80 are open to the atmosphere. Because the modulating gas valve is not yet open during this time, the exhaust gas in the stack 80 which enters the various conduits does not contain the products of combustion nor have a high moisture content which might cause corrosive condensation. By contrast, during the combustion cycle, when the flapper valve plate 206 seals the conduits 186, 188, 207, 209, no gas flow occurs in these conduits. Thus, the various passageways which are exposed to exhaust gas products are flushed out during the start up phase of each furnace cycle.

A further advantage of the present system is that it automatically shuts off in response to a blocked stack condition. Should such a condition occur, the differential pressure across the orifice 70 or **70*b* would tend toward zero. With a sharp drop in differential pressure as caused by severe stack blockage, the flapper valve plate 206 will unseat, causing the gas valve 100** to shut down.

Among the enhancements or variations of the present invention are certain additional safety features. For example, the temperature sensor 57 may include a third, danger-condition, setpoint, at a temperature level higher than its setpoint to turn the fan 34 on and off, and second normally-closed contacts 59, actuated by the sensor 57 and placed in series with the primary side of the transformer 210, as shown in FIG. 4. The danger-condition setpoint is chosen such that an abnormally high heat exchanger temperature can be detected. When such a temperature is detected, the second, normally closed contacts 59 are opened, cutting power to the primary side of the transformer 210, and the system is shut off. This avoids dangers caused by continued burning with an abnormally high heat-exchanger temperature.

A second additional safety feature which can be incorporated in the present control system is a pressure sensor which detects low outlet gas pressure, a condition which can sometimes lead to abnormal combustion in the burner 40. This low gas pressure sensor would sense pressure in the gas outlet pipe 104, and would only be enabled once a normal burning phase had started, so that it would not interfere with start-up. Activation of the low gas pressure sensor would cause the gas to be shut off and the rest of the system to be shut down normally, by a mechanism similar to that used in the case of stack blockage.

It will be obvious to one skilled in the art that a number of modifications can be made to the above-described embodiments without essentially changing the invention. For example, various solid-state sensors and switching devices may be substituted for certain bimetal thermostatic elements and the contacts and relays shown. It is also clear that the feedback differential pressure signal representing exhaust gas flow may be transmitted by other means, such as mechanical or electrical arrangements, and that data other than pressure which have the desired correspondence with exhaust gas flow rates, may be used in the feedback loop. Moreover, the induced draft blower and exhaust gas flow feedback concept could be adapted to various other kinds of heating systems, using other fuels, in which derating and regulating mass flow rates of the combustion input materials can affect system efficiency. One skilled in the art would also realize that the present invention can be used as a design for retrofitting existing furnaces, including natural draft furnaces, or as a design for the manufacture of new furnaces. Accordingly, while various embodiments of the invention have been illustrated and described, it is to be understood that the invention is not limited to the precise constructions herein disclosed, and the right is reserved to all changes and modifications coming within the scope of the invention as defined in the appended claims.

Having thus described the invention, what is claimed as new, and desired to be secured by Letters Patent, is:

1. In a heating system of the type having a combustion chamber with a fuel burner, an inlet for combustion air, and an exhaust stack for exhaust gas, the improvement comprising:

a blower connected to the exhaust stack for inducing exhaust gas flow through the exhaust stack and for drawing combustion air into the combustion chamber;

means for variably controlling the flow of exhaust gas such that flow of exhaust gas through the exhaust stack and of combustion air into the combustion chamber are simultaneously regulated; means adapted to be mounted in the exhaust stack for forming a flow restriction in the exhaust stack on one side of the blower, said flow restriction, in cooperation with said blower, causing a pressure differential between the exhaust gas pressures on either side of the flow restriction;

first fuel supply control means having an "on" state and an "off" state and being adapted to control the supply of fuel to the burner responsive to a control signal representative of the exhaust gas pressure differential across the flow restriction, whereby said first control means is turned "on" when the pressure differential exceeds a first, predetermined value and is turned "off" when the pressure differential falls below a second, predetermined value, which is less than said first predetermined value;

second fuel supply control means adapted to variably control the supply of fuel to the burner responsive to the state of the first fuel supply control means and to a control signal representative of the exhaust gas pressure differential across the flow restriction, whereby the supply of fuel is regulated to a rate proportional to the magnitude of the pressure differential during the period when said first control means is "on"; and means for sensing the exhaust gas pressure differential across the flow restriction and for communicating said sensed pressure differential as a control signal to the first and second fuel supply control means.

2. The heating system as recited in claim 1 wherein the fuel is a gas, wherein said means for sensing and communicating said sensed pressure differential is a conduit connected to the exhaust stack and to the first and second fuel supply control means, said conduit having at least two passages for communicating the exhaust pressures comprising said pressure differential, and wherein said first and second fuel supply control means are responsive to exhaust pressures.

3. The heating system as recited in claim 2 wherein the conduit comprises a first, exterior tube and a second, interior tube, collinear and enclosed within said first tube, whereby a first pressure communicating passage exists in the region between the first and second tubes and a second pressure communicating passage exists within the second tube.

4. The heating system as recited in claim 3 wherein the flow restriction means is located on the downstream side of the blower and the conduit is connected to the exhaust stack such that the first pressure communicating passage receives the pressure existing at the upstream side of the flow restriction and the second pressure communicating passage receives the pressure existing at the downstream side of the flow restriction.

5. The heating system as recited in claim 3 wherein the flow restriction means is located on the upstream side of the blower and the conduit is connected to the exhaust stack such that the first pressure communicating passage receives the pressure existing at the downstream side of the flow restriction and the second pressure communicating passage receives the pressure existing at the upstream side of the flow restriction.

6. The heating system as recited in claim 3 wherein the first and second tubes are concentric.

7. The heating system as recited in claim 6 wherein at least two webs run longitudinally within the first pressure communicating passage whereby the first pressure communicating passage is subdivided into at least two separate and distinct compartments.

8. The heating system as recited in claim 7 wherein at least one of the separate and distinct compartments formed by the webs is used as an electrical raceway.

9. The heating system as recited in claim 1 wherein the means for variably controlling the flow of exhaust gas comprises means connected to the blower for variably controlling the volume delivery rate of the blower.

10. The heating system as recited in claim 9 wherein the means for variably controlling the volume delivery rate of the blower comprises means for operating the blower at a first, higher delivery rate and a second, lower delivery rate.

11. The heating system as recited in claim 10 wherein the first, higher delivery rate causes the heating system to operate at substantially its design maximum firing rate and said second, lower delivery rate causes the heating system to operate at a firing rate substantially less than its design maximum.

12. The heating system as recited in claim 2 wherein the second fuel supply control means comprises a regulator diaphragm chamber having first and second subchambers separated by a diaphragm, wherein said sensed pressure differential is communicated by introducing the pressure from one of said at least two exhaust pressure communicating passages to said first subchamber and the pressure from the other of said at least two exhaust pressure communicating passages to said second subchamber and wherein said first and second subchambers are connected to first and second vent conduits, respectively, for venting the pressure from said subchambers and wherein the first fuel supply control means comprises flapper valve means responsive to the sensed pressure differential for closing off said first and second vent conduits when the pressure differential exceeds the first predetermined value and for opening said first and second vent conduits when the pressure differential falls below a second predetermined value, whereby the pressure differential is operative in said regulator diaphragm chamber only when said vent conduits are closed off.

13. The heating system as recited in claim 12 wherein the flapper valve means comprises:

a flapper valve diaphragm chamber having first and second subchambers separated by a diaphragm, said sensed pressure differential being communicated to said flapper valve chamber by introducing the pressure from one of said at least two exhaust pressure communicating passages in said first subchamber and the pressure from the other of said at least two exhaust pressure communicating passages in the second subchamber;

a movable flapper valve seal for selectively sealing the vent conduits, said valve seal having a sealing and an unsealing position;

means connecting said flapper valve seal to said flapper valve diaphragm for cooperating movement, whereby said flapper valve seal moves to its sealing position to seal the vent conduits when the pressure differential exceeds a first predetermined value; and magnet means for applying an attractive force to said flapper valve seal when said seal is in its sealing position, said magnet means having substantially no attractive effect on said flapper valve seal when said valve seal is in its unsealing position.

* * * * *